US007331767B2

(12) United States Patent
Spiegl et al.

(10) Patent No.: US 7,331,767 B2
(45) Date of Patent: Feb. 19, 2008

(54) METHOD OF STEPLESS CAPACITY CONTROL OF A RECIPROCATING PISTON COMPRESSOR AND PISTON COMPRESSOR WITH SUCH CONTROL

(75) Inventors: Bernhard Spiegl, Vienna (AT); Peter Steinrück, Hallstatt (AT); Gunther Machu, Vienna (AT); Michael Miks, Alland (AT)

(73) Assignee: Hoerbiger Kompressortechnik Services GmbH, Wien (AT)

( * ) Notice: Subject to any disclaimer, the term of this patent is extended or adjusted under 35 U.S.C. 154(b) by 536 days.

(21) Appl. No.: 10/664,042

(22) Filed: Sep. 17, 2003

(65) Prior Publication Data

US 2004/0091365 A1 May 13, 2004

(30) Foreign Application Priority Data

Sep. 19, 2002 (AT) ..... A 1417/2002

(51) Int. Cl.
*F04B 49/06* (2006.01)

(52) U.S. Cl. ..... 417/53; 417/298; 417/446

(58) Field of Classification Search ..... 417/298, 417/446, 53

See application file for complete search history.

(56) References Cited

U.S. PATENT DOCUMENTS

| | | | | |
|---|---|---|---|---|
| 1,623,489 | A * | 4/1927 | Naab | 417/446 |
| 2,296,304 | A | 9/1942 | Wolfert | |
| 2,626,100 | A | 1/1953 | McIntyre | |
| 2,961,148 | A * | 11/1960 | Courtney, Jr. | 417/298 |
| 2,991,924 | A * | 7/1961 | Ramsay | 417/446 |
| 5,378,117 | A | 1/1995 | Bennitt | |
| 5,634,492 | A | 6/1997 | Steinrück et al. | |
| 5,833,209 | A | 11/1998 | Steinrück | |
| 2004/0091365 | A1 | 5/2004 | Spiegl et al. | |

FOREIGN PATENT DOCUMENTS

| | | |
|---|---|---|
| AT | 402090 | 1/1997 |
| DE | 19723261 | 12/1998 |
| DE | 10005388 | 9/2001 |
| EP | 1400692 | 8/2003 |
| GB | 2352780 | 2/2001 |
| WO | 9503490 | 2/1995 |
| WO | 9622466 | 7/1996 |
| WO | 0175278 | 11/2001 |

* cited by examiner

*Primary Examiner*—Michael Koczo, Jr.
(74) *Attorney, Agent, or Firm*—Dykema Gossett PLLC

(57) ABSTRACT

For stepless capacity control of a reciprocating piston compressor, an unloader (2) arranged on a suction valve (1) keeps open said suction valve (1) over a thereby controllable portion of the working cycle of the compressor by means of an unloading piston (4) biased by gas pressure via a control valve (3). The gas pressure biasing the unloading piston (4) is always above the gas pressure required to overcome the maximum possible reverse flow force, whereby a controllable partial discharge of the unloading cylinder (6) is performed in each phase of the working cycle up to the closing of the suction valve (1) by means of the control valve (3), which is designed to switch rapidly. The theoretical discharge time of the entire discharging volume for the partial discharge is preferably maximal nearly equal or even less than twice the duration of the working cycle.

3 Claims, 5 Drawing Sheets

METHOD OF STEPLESS CAPACITY CONTROL OF A RECIPROCATING PISTON COMPRESSOR AND PISTON COMPRESSOR WITH SUCH CONTROL

BACKGROUND OF THE INVENTION

1. Field of the Invention

The invention relates to a method for stepless capacity control of a reciprocating piston compressor whereby an unloader arranged on at least one automatic suction valve of the compressor keeps open at least one sealing element of the suction valve throughout a thereby controllable portion of the working cycle of the compressor through a switchable control valve having an unloading piston (draw piston) biased by gas pressure. The invention relates further to a corresponding reciprocating piston compressor with stepless capacity control having an unloader attached on at least one automatic suction valve of the compressor whereby the unloader keeps open at least one sealing element of the suction valve throughout a thereby controllable portion of the working cycle of the compressor by means of an unloading piston biased by gas pressure via a switchable control valve.

2. The Prior Art

Compressors known to have also reverse flow controls with stepless capacity control of the described type are known in the art. See in this regard U.S. Pat. No. 2,296,304 A, U.S. Pat. No. 2,626,100 A or U.S. Pat. No. 5,378,117 A, for example. In all known methods and devices of the aforementioned type, there is already set or adjusted the engagement force of the unloader influencing the sealing element of the suction valve via an unloading cylinder biased by gas pressure or the pressure biasing the unloading piston therein. Up to now, this pressure has always been essentially constant or has been adjusted by a pressure regulator or also by pulsating switching control valves.

This type of capacity control takes advantage of the fact that the engaging flow force, which exists during the compression stroke at the sealing element of the suction valve that is kept open by the unloader—and which is thus termed as reverse flow force—increases at first with the progressing crank angle during the compression stroke, passes a maximum that corresponds to the piston velocity, and advances at the end of the compression stroke toward zero when reaching the upper dead center of the piston. Through an adjustment of the unloading force biasing the unloading piston by means of a prorated amount of gas pressure in the unloading cylinder, there can be determined the crank angle at which the unloading force is overcome by the reverse flow force (together with the possible spring action of the sealing element) whereby the arrangement consisting of the open sealing element and the unloader is accelerated in movement in the closing direction of the suction valve. The crank angle for closing of the suction valve can be adjusted in this manner in a continuous (infinite variable) manner between the lower dead center and the crank angle corresponding to the maximum of the reverse flow force (and the corresponding delivery amount of the compressor can be adjusted thereby.)

It is a direct disadvantage in the described method or the corresponding disclosed devices in that the closing crank angles, existing after the arrival of the maximum reverse flow force, can naturally not be realized, which results in a limited range of control that lies approximately between 40 to 100 percent of the maximal possible delivery amount.

Especially in the production of PET (polyethylene) bottles, there are nevertheless a great number of air compressors employed, for example, which experience a highly fluctuating air requirement of 10 to 100 percent and which must maintain a very constant end pressure at the same time.

It is an additional disadvantage that the required gas pressure necessary for the adjustment of a specific delivery amount and directly influencing the gas pressure in the unloading cylinder depends on many parameters, such as gas density, operational pressure, speed of the compressor and the like, which results in additional complicated and failure-susceptible control methods or control mechanisms.

Another known method for capacity control in compressors is the intermittent operation of the compressor (on/off control) whereby the suction valves are alternately kept open by means of unloader actuation or whereby they are permitted to open and close automatically. This control by unloader actuation can be basically used for adjustment of an average delivery amount between 10 percent and 100 percent but it causes various additional disadvantages: The compressor runs alternately at full power or idle. While running idle, the unfavorable degree of effectiveness and the high phase shift of the three-phase A.C. motor employed to drive compressors lead to high energy consumption or large amounts of reactive current (idle current). The sealing elements of the rod packing are not being scavenged by gas leakage during idle operation and are thereby not cooled, or the heat developing at the open suction valves by the lack of ventilation is not dissipated via the delivery medium. The thereby developing increase in heat and the deformation of the sealing element as a result of temperature changes promotes the wear of ring components and packing components.

Aside from the problems with rings and packing, this type of control is also responsible for damages to the valves. The reciprocal movement of the unloader over conventional diaphragm cylinders or other cylinders is possible only within several compression cycles based on the large volumes, the clearance volume, the small cross section of the inlet lines, the great length of the lines, the small cross section of the switch and the long switch-over times of the control valves. The sealing element of the suction valve, normally a valve plate, impacts the unloader prongs several times during the reciprocal movement. This can accelerate or initiate the breaking of valve plates.

Constant pressures in the pressure reservoir of compressors having conventional on/off controls are dependent on the reservoir volumes and may be realized only by frequent switching between idle operation and operation under full power (several times per minute.) Components of the piston cylinder and of the diaphragm cylinder are generally not suited for frequent switching and are subject to increased wear.

Methods and devices have been disclosed to avoid the described disadvantages whereby a unloading force is provided by hydraulic means acting upon the unloader against the reverse flow force of the gas to be compressed whereby said unloading force is suddenly reduced at a specific crank angle and whereby secure and rapid closing of the suction valve is initiated. Such devices, as disclosed in AT 403 835 B, for example, use systems for this purpose which are highly suitable based on the low compressibility of the employed actuation fluids, but which have the disadvantage that they are designed relatively complicated and that they need additionally an hydraulic assist energy that must be provided through additional aggregates.

It is the object of the present invention to improve the reverse flow control actuated by means of gas pressure of the aforementioned type in such a manner that the cited disadvantages do not occur, particularly to avoid in a simple way the above-mentioned limitations in the range of control as well as the negative influences of fluctuations in the necessary unloading gas pressure.

SUMMARY OF THE INVENTION

This object is achieved according to the present invention in a method of the aforementioned type in that the gas pressure biasing the unloading piston is always above the gas pressure required to overcome the maximum possible reverse flow force during the time in which the control valve is closed, and in that controllable partial discharge of the unloading cylinder is performed until the closing of the suction valve through a control valve that is designed for rapid switching in each phase of the working cycle. Through this measure, there can be freely chosen, essentially in total, the position of the closing crank angle within the working cycle of the compressor, on one hand—whereby the closing crank angles can also be realized that exist after reaching the maximum reverse flow force—and whereby essentially a range of control is possible for the capacity control of 0 to 100 percent of the maximum delivery amount. On the other hand, the gas pressure biasing the unloading piston is no longer directly responsible for the closing crank angle—as long as this pressure lies only for all operational conditions or cited parameters above the gas pressure required to overcome the maximum possible reverse flow force—as a result, the fluctuation of the cited parameters cannot have a substantial influence on the capacity control. The rapid-switching control valve causes in each phase of the working cycle and at a specific crank angle a partial discharge of the unloading cylinder whereby the gas pressure drops in the unloading cylinder. As soon as this gas pressure or the resulting unloading force drops below a threshold at which there exists an equilibrium between the reverse flow force and the possible spring action of the sealing element, the previously open suction valve closes whereby the normal compression or delivery capacity of the compressor starts with a correspondingly reduced delivery amount. As soon as the previously open suction valve closes in this manner, it is closed by the pressure building up in the working chamber of the compressor cylinder and it opens again only at the start of the next suction stroke. The unloading cylinder is again biased with the gas pressure required to overcome the maximal possible reverse flow force through closing of the control valve causing the described partial discharge before the next working cycle of the compressor so that there is guaranteed secure holding in the open position of the sealing element of the suction valve until the next discharge through the control valve.

As the gaseous actuation medium for unloader piston shows a relatively high compressibility, there must be maintained, of course, specific conditions in each phase of the working cycle to make possible and to guarantee the partial discharge of the unloading cylinder leading to the closing of the suction valve. It has now been shown that these conditions can be maintained in a very advantageous manner in a preferred embodiment of method and device according to the invention, in that there is a dependency in volume to be discharged consisting of the stroke volume of the unloading cylinder and the clearance volume between the control valve and the unloading piston, the cross section of the opening of the control valve, the gas used for actuation of the unloader whereby the theoretic discharge time of the entire volume to be discharged is maximal nearly equal or less then twice the duration of a working cycle of the compressor. It has been shown that a sufficiently accurate control quality of capacity control is provided thereby over the entire range of at least nearly 0 to 100 percent of the maximum delivery capacity since the partial discharge in the unloading cylinder necessary for the actual closing of the suction valve takes place still within a fraction of the working cycle of the compressor. An additional reduction in discharge time provides advantages if the discharging gas pressure acting upon the unloading piston lies greatly above the gas pressure required to overcome the maximal possible reverse flow force, which is, however, not necessary in itself. An extension of the cited discharge time without a substantial negative influence on the possible range of control would make necessary a decrease of the gas pressure acting upon the unloading piston to a value just over the gas pressure required to overcome the maximal possible reverse flow force, which then causes again problems with outside parameters in influencing this gas pressure and it causes continuous irregularities in control.

It has been shown in case of a discharge time greater than approximately three-fold the duration of the working cycle that the control behavior of the system is determined essentially only by the average pressure existing in the unloading cylinder whereby the manner of functioning corresponds approximately to the disclosed pneumatic reverse flow control described in the beginning (together with its described disadvantages.) With the amount of the mentioned discharge time of between twice or three-fold the duration of the working cycle of the compressor there appears a complex control behavior that depends on the switch-over time of the control valve as well as on the gas pressure to influence the unloading cylinder. It is therefore very advantageous for the desired control behavior of the inventive method if the above described resulting theoretic discharge time of the entire volume to be discharged is less than twice the duration of one working cycle of the compressor. The theoretic discharge time T of the volume V to be discharged, the cross section of the opening of the control valve f and the sonic velocity c of the gas biasing the unloading piston are in following relationship:

$$T = \frac{V}{K(kappa) \times kappa \times f \times c}$$

with: K (kappa)

a constant dependent on the isentropic exponent of the biasing gas

K(kappa)=0.155 for air (kappa=1.4)

Remarks: K(1.4)=0.155 for discharge of 5 percent of the initial pressure (critical pressure condition over the entire discharge (blowoff) process is assumed).

Since sufficiently rapid-switching control valves can be realized only for small cross sections of the opening (f), an additional embodiment of the inventive compressor is advantageous according to which the clearance volume between control valve and unloading piston is maximal nearly equal or smaller than twice the stroke volume of the unloading cylinder.

In an additional preferred embodiment of the compressor according to the invention, the guide of the unloader and/or the control valve form one structural unit together with the unloading cylinder and/or the piston, which makes designs possible in a very simple and compact manner which are provided with a minimal clearance volume of the aforementioned type.

In an additional embodiment of the invention, the control valve is designed as a solenoid-actuated 3/2-port directional control valve and is preferably switched in such a manner that it acts upon the unloading cylinder with gas pressure while being without electric power. In case of failure of the control electronics for the valve, the compressor operates in this way with an open suction valve whereby through the decrease of gas pressure biasing the unloading cylinder, the unloader is pulled back and the compressor can be brought thereby to full power. Thus, emergency operation without continuous control is also possible.

The unloading cylinder can thereby be directly integrated or formed in one piece in combination of control valve and unloader. The control valve is positioned in direct proximity of the unloading cylinder within the suction valve or the unloader guide and forms a 3/2-port directional control valve. The valve switches over as desired the gas supply or the discharge (blowoff) line to the unloading cylinder. Because of the very short switch-over times and the high switching speeds, there occurs no considerable gas loss during the switch-over process (the embodiment corresponds thereby to a 3/3-port directional control valve whereby the center switching position is rapidly passed and cannot be directly triggered either.) A very rapid response and engagement of the unloader can be realized after each working cycle through the embodiment having a very small clearance volume due to short lengths of the line between the unloading cylinder and the control valve combined with the rapid-switching solenoid.

According to an especially preferred additional embodiment of the invention, the control valve is biased at the inlet side with the compressed gas itself being under a corresponding pressure, whereby said control valve is preferably connected to a reservoir volume which is connected in turn to the working chamber of the compressor via a check valve. An outside supply of a separate gas to act upon the unloading cylinder is not needed but it requires an additional connection from the working chamber of the compressor to the control valve via the reservoir.

In an additional embodiment of the invention, the unloading piston can partially shut off the inlet and/or the discharge of the gas biasing the unloading cylinder whereby pneumatic end-position damping is realized for the unloading piston in a simple manner.

BRIEF DESCRIPTION OF THE DRAWINGS

The invention will be explained in more detail in the following with the aid of accompanying drawings.

DETAILED DESCRIPTION OF THE PREFERRED EMBODIMENTS

Figure 1:
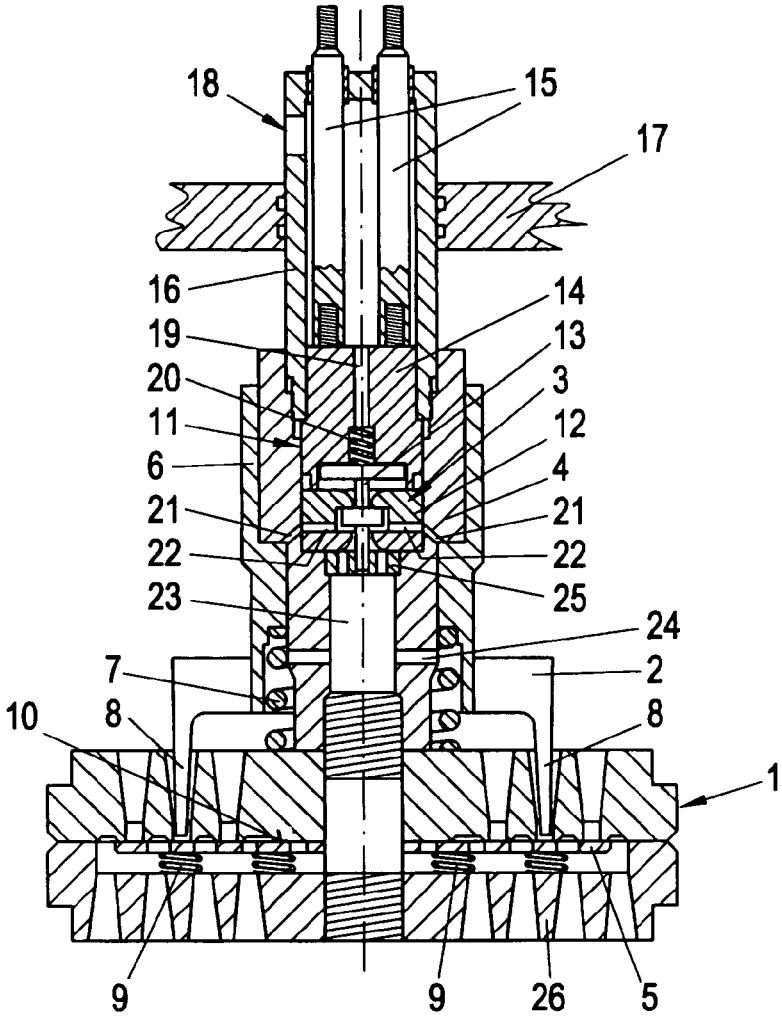
FIG. 1 shows an axial section of a suction valve of a reciprocating piston compressor designed according to the invention.

In all embodiments according to FIG. 1 through FIG. 6, an unloader 2 is arranged on the suction valve 1 of the compressor whereby the unloader 2 keeps at least one sealing element of the suction valve 1 over a thereby controllable portion of the working cycle of the compressor by means of an unloading piston 4 biased by gas pressure via a switchable control valve 3. The unloading piston 4 is here stationary and fixed centrally on the suction valve 1 and it forms with its outer circumference, and thereby directly in axial direction, the guide for the unloader 2 or the sleeve-like upper part of the unloader 2 forming thereby the axially movable unloading cylinder 6. In the position illustrated in FIG. 1, the unloader 2 is pushed into the upper end position by means of a helical spring 7 wherein the unloading piston 4 rests against the face of the unloading cylinder 6 and whereby the unloader prongs 8 are lifted away from the sealing element 5, which in turn abuts the valve seat 10 under the influence of the valve spring 9 as long as there does not occur an automatic unloading of the sealing element 5 against the valve springs 9 during the suction stroke.

The control valve 3 is inserted into a central bore 11 in the region of the unloading piston 4 whereby said control valve 3 consists essentially of a seat body 12, a switch element 13, and a solenoid 14 (illustrated only schematically.) The solenoid 14 is provided with screwed-on contacts 15 at its top side in the illustration whereby the contacts 15 serve for switchable electric power supply and they protrude upwards from the housing 16. The remaining connecting lines or associated electric trigger elements are not illustrated here.

The housing 16 is screwed onto the top side of the stationary unloading piston 4 and serves at the same time to fix the solenoid 14 or the complete control valve 3 in the unloading piston 4 and is provided with a connection aperture 18 outside of the housing wall 17 for the pressurized gas (preferably the process gas directly) and leading to the unloading cylinder 6 via the control valve 3 whereby the gas reaches the control valve 3 via a central bore 19 in the solenoid 14 and via the space receiving the spring 20 on the top side of the switching element 13.

According to FIG. 1, the upper valve seat of the seat body 12 of the control valve 3 is closed off in the illustration by the switching element 13 which is pulled upwardly under the effect of the turned-on solenoid 14 whereby the associated lower seat is opened. The supply of the actuation gas from the connection aperture 18 to the unloading cylinder 6 is thereby blocked. The cavity of the unloading cylinder is discharged in the direction of the center bore 23 and the radial bores 24 through the bores 21 in the stationary unloading piston 4 or the associated bores 22 in the seat body 12 of the control valve 3. In this connection there is to be mentioned the guide disk 25 for the switch element 13 or its lower guide pin which is provided with a through-passage for the gas to be discharged.

Figure 2:
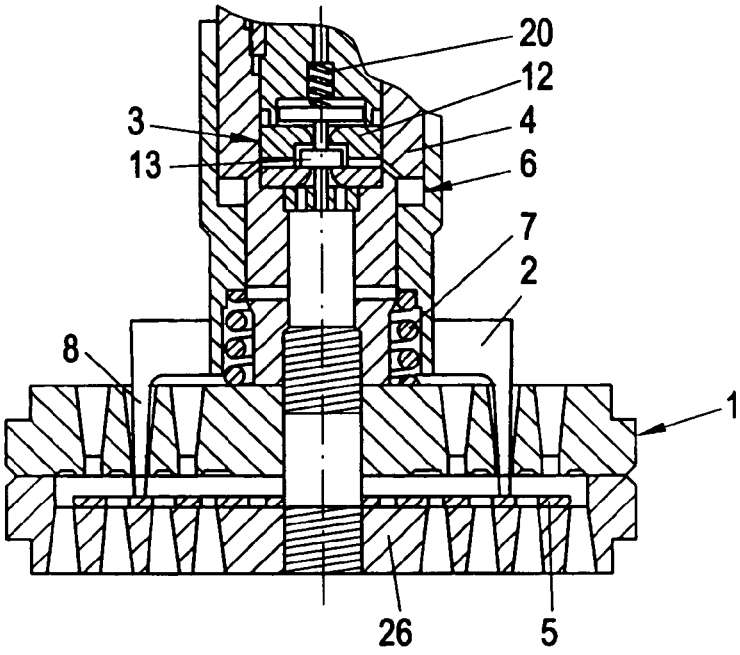
FIG. 2 shows the arrangement according to FIG. 1 in a position of the sealing element of the suction valve kept open by means of the unloader.

The electric power supply to the solenoid 14 is interrupted to engage the unloader 2 onto the sealing element 5 or to lift the same into the position illustrated in FIG. 2 whereby the switch element 13 is pushed downwardly under the influence of the spring 20 and whereby the switch element 13 opens the upper seat of the seat body 12 in the illustration and closes the lower one. Pressure can thereby build up in the unloading cylinder 6 via the bores 22 in the seat body 12 and the connecting bores 21 in the unloading piston 4 whereby the pressure build-up in the unloading cylinder 6 subsequently pushes the unloading cylinder 6 down together with the unloader 2 against the effect of the helical spring 7, and whereby the sealing element 5 of the suction valve is kept open in the arrangement on the valve catch 26.

The pressure of the actuating gas supplied through the connection aperture 18 and acting upon the unloading piston 4 or the unloading cylinder 6 lies always above the pressure necessary to overcome the maximal possible reverse flow force on the sealing element 5 so that a secure open position of the sealing element 5 of the suction valve 1 is possible over the complete working cycle of the compressor. The control valve 3 switches rapidly as a result of its design, actuation and trigger element and it makes possible thereby at each phase of the working cycle a controllable partial discharge from the unloading cylinder 6 up to the desired closing of the suction valve at a specific crank angle. It is essential thereby according to the inter-relationship presented in detail already in the beginning that there is a dependency of volume to be discharged, the cross section of the opening of the control valve 3, and the gas used for actuation of the unloader 2 whereby the theoretic discharge time of the entire volume to be discharged is maximal nearly equal or less then twice the duration of a working cycle of the compressor so that the periodic closing of the previously open suction valve can actually occur without neglecting the compressibility of the actuation gas. The volume to be discharged consists thereby of the actual working volume in the unloading cylinder 6 and of the clearance volumes defined essentially by the volume of the bores 21 and 22, which are therefore to be kept as small as possible.

Figure 3:
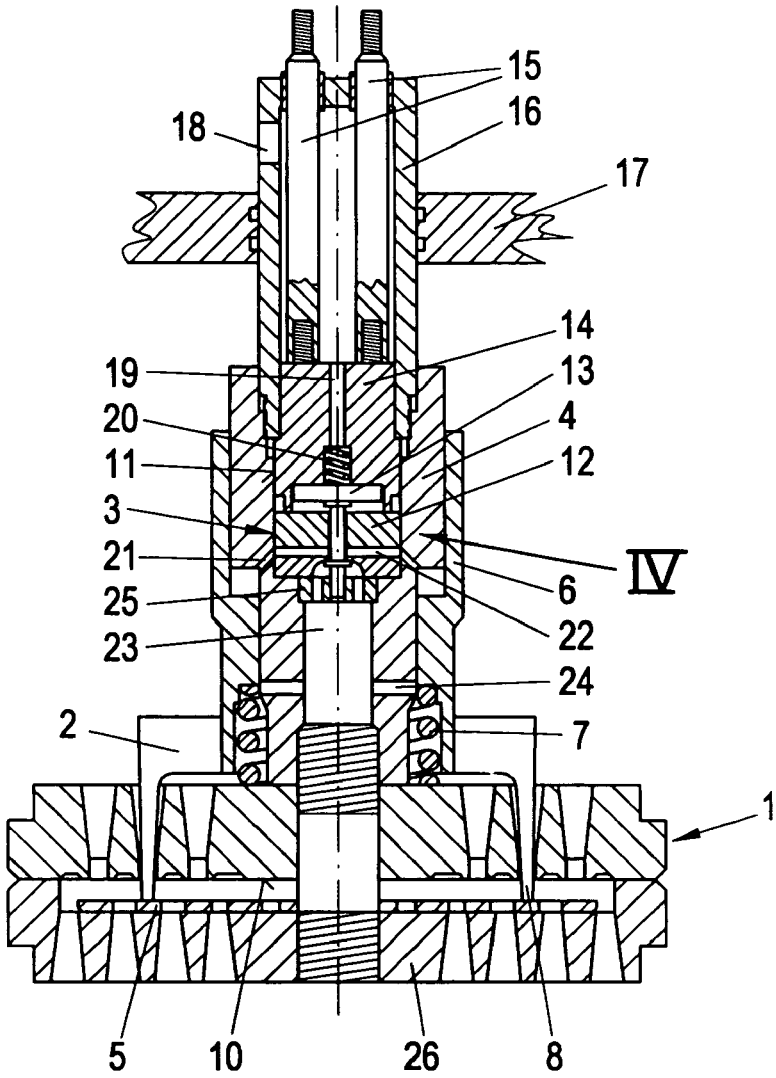
FIG. 3 shows another embodiment example according to the invention in an illustration substantially corresponding to FIG. 1.
Figure 4:
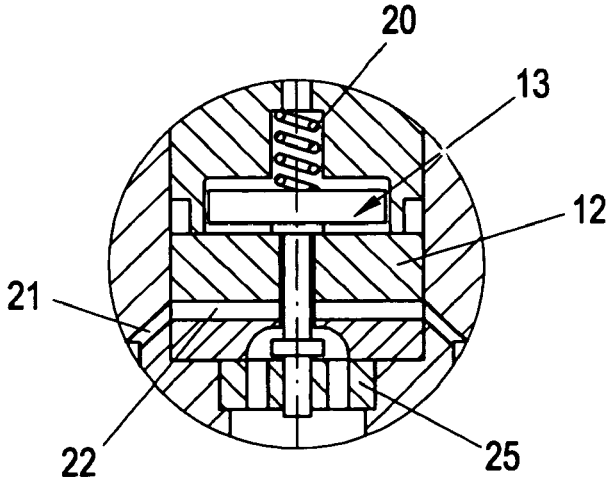
FIG. 4 shows the detail IV from FIG. 3, however in another switched position of the control valve.

While the control valve 3 in the embodiment of FIG. 1 and FIG. 2 influences the cavity of the unloading cylinder 6 with gas pressure in the absence of electric power (according to FIG. 1) and keeps the suction valve 1 open thereby, it is proposed in the otherwise comparable or to a great extent identical embodiment according to FIG. 3 and FIG. 4 that the control valve 3 supplies the unloading cylinder 6 with unloading pressure as a result of the different designs of the seat body 12 and the switch element 13 while the solenoid 14 is under power as illustrated in FIG. 3. The upper valve seat on the seat body 12 is thereby open and the lower valve seat in the direction of discharge is closed and the supply of the pressurized actuation gas from the connection aperture 18 to the cavity of the unloading cylinder 6 is also free therefore. During a shut-off of the electric power supply through the contacts 15 to the solenoid 14, the switch element 13 assumes the lower switching position urged by the spring 20, as illustrated in FIG. 4 in an enlarged manner, whereby the upper valve seat is closed and the lower valve seat is opened in the direction of discharge and the unloader 2 biased by the helical spring 7 is pulled back, and the sealing element 5 of the suction valve 1 can close corresponding to the influencing flow forces or the valve spring 9, which can be seen in FIG. 1.

Figure 5:
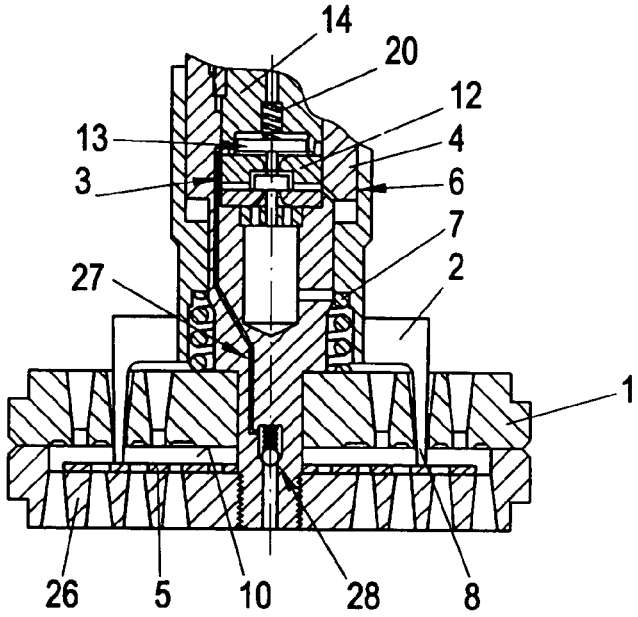
FIG. 5 and FIG. 6 show embodiment examples according to the invention in an illustration again substantially corresponding to FIG. 1.

While in the embodiment according to FIG. 1 through FIG. 4 the gas used for actuation of the unloader 2 is separately supplied through the connection aperture 18 whereby it can originate actually from any desired pressure source, there is provided for this purpose in the embodiment in FIG. 5 a connecting line 27 in the center bolt of the suction valve 1 or in the center piece made in one piece here—which gradually changes in the upper region again into the stationary unloading piston 4. A check valve 28 is provided at the lower side of the connecting bore 27 facing the working chamber of the compressor (not illustrated here) whereby the check valve 28 ensures always sufficient pressure on the side above the connecting line 27—there could also be provided a separate reservoir (not further illustrated) to increase the supply of actuation gas being under corresponding pressure. Aside from this different way of making the actuation gas available, the embodiment in FIG. 5 corresponds essentially to the one shown in FIG. 1 and FIG. 2. Identical parts are identified with the same reference numbers—one is referred to the above embodiments in regard to the description of function.

Figure 6:
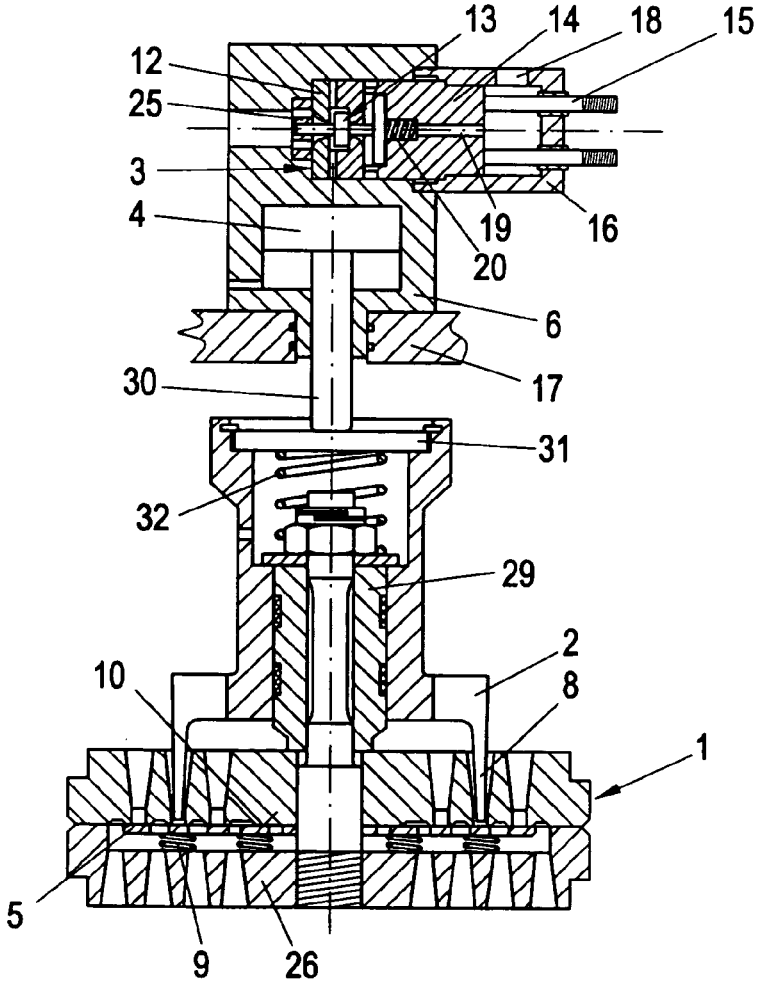

In the embodiment according to FIG. 6, the unloading cylinder 6 together with the unloading piston 4 is now no longer combined with the unloader 2 or its center guide pin 29, but it is combined only with the control valve 3 together with its electromagnetic actuation. The entire actuation unit formed hereby is separately placed upon the housing wall 17 of the compressor and is in operational cooperation with the pressure plate 31 on the unloader 2 via the piston rod 30 of the unloading piston 4 whereby the pressure plate 31 is biased at the other side by a helical spring 7, and in FIG. 1 through FIG. 5 it is biased by a corresponding spring 32. Otherwise identical or at least components acting identical in the way of functioning are again provided with the same reference numbers as in FIG. 1 through FIG. 5—in regard to the description of function of the arrangement in FIG. 6, one is referred to the embodiments above in FIG. 1 and FIG. 2 being essentially identical embodiments in their way of operation.

It is again of essence in the embodiment according to FIG. 6 that the clearance volume between the control valve 3 and the unloading piston 4 must be kept as small as possible to enable a sufficiently rapid partial discharge of the working volume of the unloading cylinder 6 together with the clearance volume up to the closing of the open suction valve 1 during each working cycle of the compressor.

In the following, the functioning of the inventive method for stepless capacity control of a reciprocating piston compressor is explained in more detail with the aid of the illustrations in FIG. 7 and FIG. 8.

Figure 7:
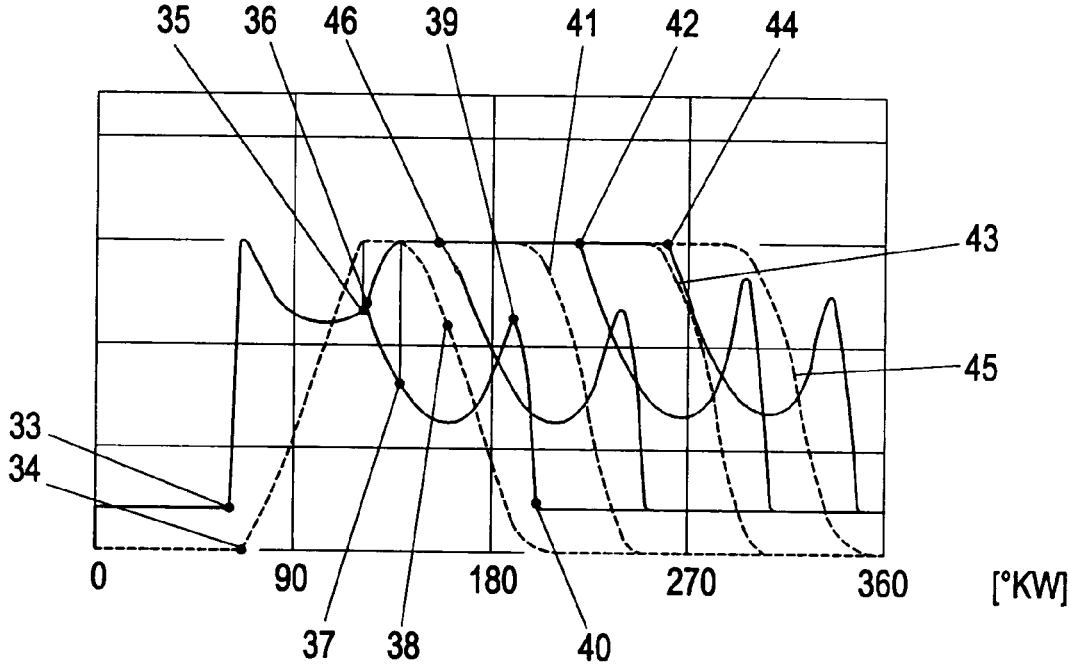
FIG. 7 and FIG. 8 show the relationship between the gas pressure in the unloading cylinder and the movement of the unloading piston or unloader for different control angles [°CA (crank angle)] of the control valve at respective differently large clearance volumes or theoretic discharge times.

FIG. 7 shows the course of the unloader movement (interrupted lines) and the control pressure (solid lines) in the unloading cylinder 6 at various switching times 37, 40, 42 and 44 of the control valve 12 for a discharge time chosen to be short according to the invention during one working cycle of the compressor ($T \approx 0.4 \times$time of cycle).

The solenoid 14 of the control valve 3 in FIG. 1 is at first influenced by electric current up to the time or the crank angle 33. The unloading cylinder 6 is thereby discharged and the unloader is kept in the pulled-back position by the closing spring 7. The pressure builds up in the unloading cylinder 6 as soon as the electric power is shut off from the solenoid of the control valve 12 and the control valve 3 frees up the connection between the pressure supply (connection aperture 18) and the unloading cylinder 6. The movement of the unloader 2 starts when the pressure (at 34) overcomes the restoring force caused by the spring 7. The gas contained in the unloading cylinder 6 expands during the engagement movement of the unloader 2 whereby the pressure in the unloading cylinder 6 falls at first since not enough gas can flow forward because of the restricted opening cross section of the control valve 3. The pressure in the unloading cylinder 6 builds up again to the value of the supply pressure as soon as the unloader 2 has reached its end position (point 35).

The control pressure drops should the solenoid 14 of the control valve 3 receive electric current again at point 37 whereby the gas captured in the unloading cylinder escapes. The force acting against the unloader 2 decreases thereby and drops below the total force acting in the closing direction of the suction valve 1 being a combination of the closing force of the valve springs 9 biasing the sealing element 5 and the restoring force of spring 7. The velocity of the unloader 2 increases at first, which can be observed from the increasingly steeper course of the movement curve starting at point 38. Since the cross sections of the bores are reduced at approaching the unloading cylinder 6 in its end position, according to one advantageous embodiment of the invention, the control pressure elevates again after passing a minimum and it reaches a maximum at 39. The movement of the unloader 2 is slowed down thereby. The unloader 2 reaches its end position at 40 with a highly reduced velocity, as illustrated in FIG. 1. The switching time 37 was selected for the hereby described movement of the unloader 2 in a manner whereby the unloader 2 is already pulled back at a crank angle of 180° to such a degree that the sealing element 5 reaches the valve seat 10 at this instant whereby no gas is pushed back into the suction chamber during this compression phase starting with this crank angle. The compressor compresses thereby the full delivery amount.

Should the switching time of the control valve 3 be selected to be at a later time, e.g. at point 46, then the pull-back movement 41 of the unloader 2 is delayed. The valve plate is closed at a later time and a part of the gas suctioned-in by the working cylinder of the compressor is once again pushed back into the suction chamber and the amount of delivery is thereby reduced. Should the control valve 3 be actuated even later, for instance at 42, then the amount of delivery is reduced further since the pull-back movement of the unloader 2 is delayed as illustrated by the line drawing 43. The pull-back movement (line 45) is delayed in the selection of the switching time of the control valve 3 at point 44 to such a degree that no pushing out of gas can be achieved necessary for the compression at the pressure side at the time of closing of the suction valve 1—the same applies for the gas captured in the working chamber of the compressor (the amount of delivery is zero.)

Figure 8:
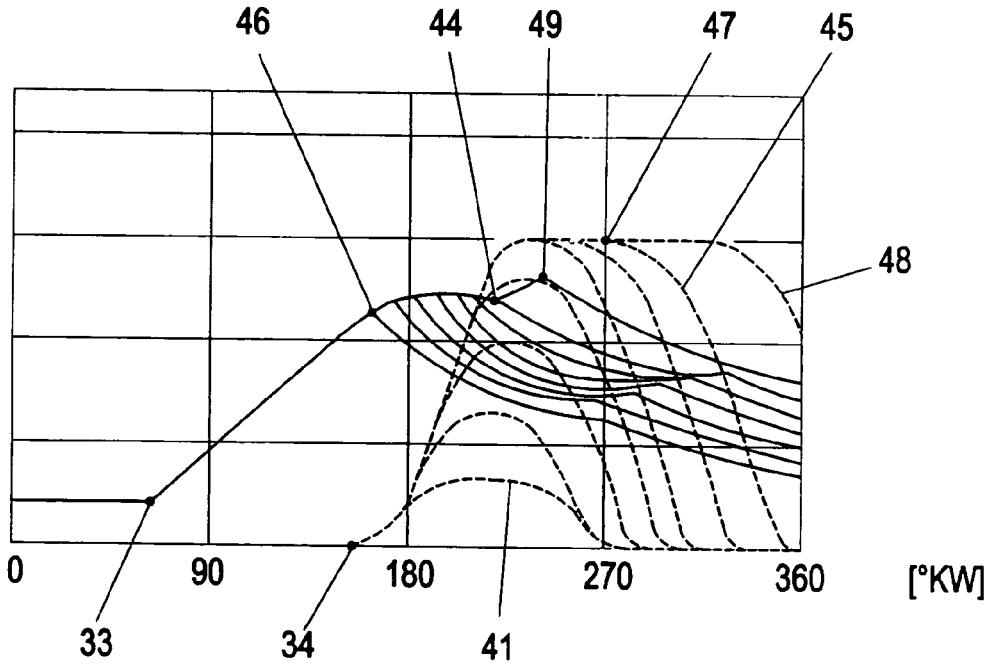

FIG. 8 shows the course of movement of the unloader and the control pressure of FIG. 7 for a clearly increased discharge time T (T≈2×time of cycle) relative to FIG. 7. One can see that the control pressure climbs only slowly after switching of the solenoid 14 of the control valve 3 at point 33 and the engagement movement of the unloader starts to be highly delayed at a considerably later time (34). The control pressure drops within a short time under the pressure necessary for actuation of the working cylinder in the selection of the switching point together with point 34 and the pull-back movement of the unloader 2 starts, as illustrated here again with the line drawing 41, so that there cannot occur any contact between the valve plate (sealing element 5) and the unloader 2. The suction valve 1 functions in a manner of operation that is uninfluenced by the unloader movement and the compressor delivers the full amount to be delivered. Should the switching time of the control valve 3 be selected later to be gradual then the lift of the unloader 2 increases, the closing of the valve plate is delayed and the amount of delivery of the compressor is reduced thereby. In the selection of the switching point with point 44 there is created a pull-back movement represented by line 45 which ends at a 360° crank angle and which corresponds to zero delivery by the compressor. An additional delay of the switching point, e.g. at point 47 (line drawing 48) prevents timely returning of the unloader into the initial position.

In FIG. 8 one can see that the maximal control pressure (at point 49) developing in the unloading cylinder 6 is only a little higher than the pressure necessary for the actuation of the unloader (point 44). This is caused by the small timely gradients of pressure increase and pressure drop. The gradients are characterized by the theoretic discharge times T described in the text above. Based on the parameters in this illustration, the discharge time is selected having the largest and still admissible value according to the invention. The time window between the earliest switching to influence the suction valve, which corresponds to the operation of the compressor at full power, and the latest switching for a timely return of the unloader 2, which corresponds to idle operation, as it can be seen from the comparison in FIG. 7 and FIG. 8, becomes steadily smaller with the increasing discharge time T and it is therefore of disadvantage for reliable control.

The mentioned gradients become flat with the selection of the discharge time T being approximately three-fold the duration of the working cycle so that the movement of the unloader 2 does no longer follow the switching of the control valve 3. The movement of the unloader 2 is then only influenced essentially by the equilibrium of the flow forces acting upon the valve plate and the mean pressure developing in the working cylinder 6. Both values depend on a plurality of parameters. The control mechanism operates then according to the known principal of the pneumatic reverse flow control mentioned in the beginning with all its associated disadvantages.

Figure 9:
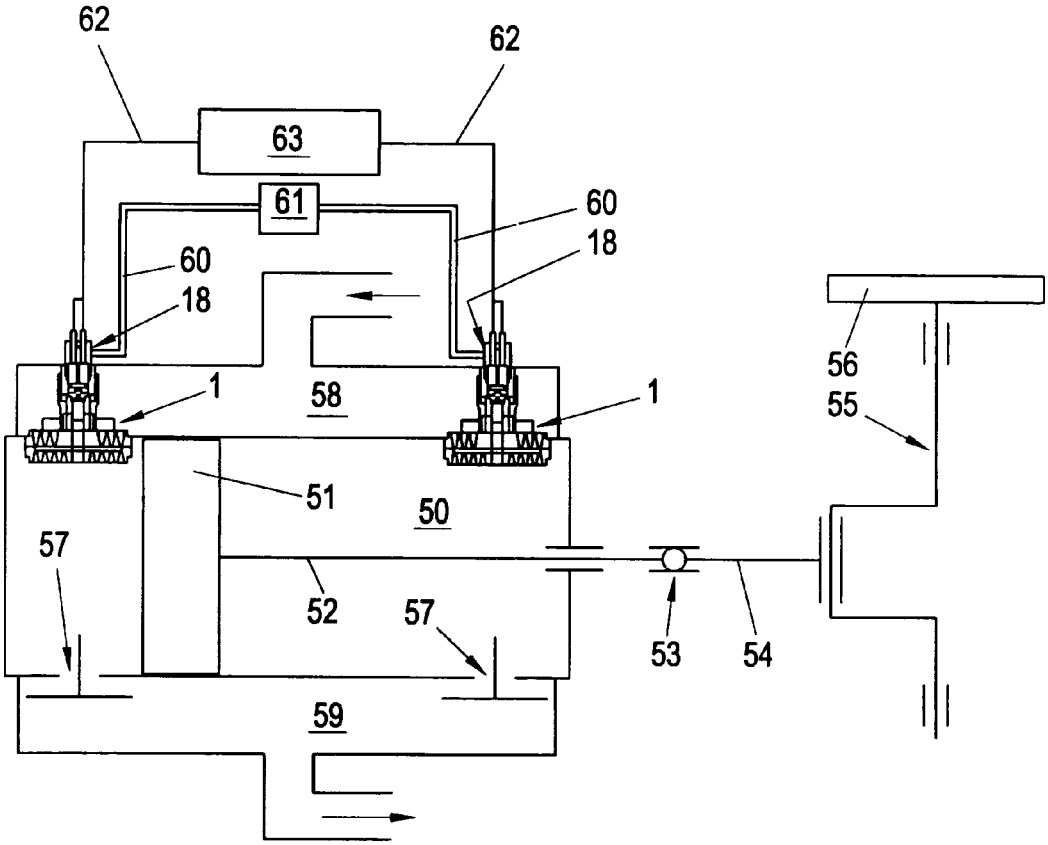
FIG. 9 shows a partial schematic cross section through a reciprocating piston compressor designed according to the invention.

In FIG. 9 is schematically illustrated an inventive reciprocating piston compressor with stepless capacity control according to the invention. The reciprocating piston 51 in the cylinder 50 is actuated by a connecting rod 54 via a projecting piston rod 52 and a universal joint 53 whereby said connecting rod 54 is mostly driven by means of an electric drive motor (not illustrated here.) The number 56 identifies a flywheel attached co-rotating on the crankshaft. On the upper side of the cylinder 50 in the illustration there are arranged the two suction valves 1 of the working chambers, which are designed according to FIG. 1 through FIG. 4, for example, and which allow stepless capacity control in the described manner. At the lower side of the cylinder 50 in the illustration there are associated pressure valves 57 indicated only. They are usually designed similar to the suction valves; however, without any control possibility. The main suction line is identified with the number 58 and the main pressure line is identified with the number 59.

Pressure lines 60 are connected to the connection apertures 18 above the cylinder 50 (see also FIG. 1 and FIG. 3) whereby the pressure lines 60 supply actuation pressure from a pressure source 61 for the unloading piston 4 or the unloading cylinder 6 (see FIG. 1 through FIG. 3). The electric triggering of the solenoid 14 of the control valves 3 occurs from a control unit 63 via the control lines 62 (see again FIG. 1 through FIG. 3 and the accompanying description.)

One is referred to FIG. 1 through FIG. 9 in regard to the detailed description of the functioning of the illustrated compressor or the therein relevant stepless capacity control of the compressor to avoid repetition, specifically of the aforementioned embodiments.

We claim:

1. A method for stepless control of a reciprocating piston compressor having a suction valve which includes a valve catch, a valve seat, a sealing element positioned between the valve catch and the valve seat and biased against the valve seat to close said suction valve, an unloader which is movable to push the sealing element away from the valve seat to open the suction valve, an unloading piston, an unloading cylinder for moving the unloader, the unloading cylinder being biased away from the valve seat and against the unloading piston, and a control valve for controlling flow of actuation gas relative to the piston and the unloading cylinder, the method comprising the steps of:

(a) moving the control valve to a first position wherein actuation gas is prevented from moving the unloading cylinder towards the valve seat so that the sealing element remains in contact with the valve seat to close the suction valve, and (b) moving the control valve to a second position wherein actuation gas flows to move the unloading cylinder and the unloader towards the valve seat to push the sealing element away from the valve seat and thereby open the suction valve, the actuation gas having a pressure sufficient to open the suction valve regardless of forces moving the sealing element towards the valve seat during a complete working cycle of the compressor.

2. A method as defined in claim 1, wherein said control valve includes a solenoid, a lower seat, an upper seat, and a switching element, and wherein step (a) includes supplying electrical current to said solenoid to move said switching element to a first location relative to the lower and upper seats, and step (b) includes discontinuing supply of electrical current to said solenoid to allow said switching element to move to a second location relative to the lower and upper seats.

3. A method as defined in claim 1, comprising the step of supplying said actuation gas from said compressor.

* * * * *